US005711434A

United States Patent [19]

Adams

[11] Patent Number: 5,711,434

[45] Date of Patent: Jan. 27, 1998

[54] AUXILIARY TOWEL RACK

[76] Inventor: Thomas F. Adams, 3961 E. River Dr., Ft. Myers, Fla. 33916

[21] Appl. No.: 732,032

[22] Filed: Oct. 16, 1996

[51] Int. Cl.[6] ..... A47F 5/01

[52] U.S. Cl. ..... 211/86; 108/42

[58] Field of Search ..... 211/86, 90, 87, 211/106, 181; 108/42, 47

[56] References Cited

U.S. PATENT DOCUMENTS

| | | | |
|---|---|---|---|
| 795,068 | 7/1905 | Schauwecker | 211/106 |
| 2,527,713 | 10/1950 | Dunn | 211/86 X |
| 3,124,253 | 3/1964 | Petrich . | |
| 3,481,487 | 12/1969 | Paruolo | 211/86 X |
| 4,372,449 | 2/1983 | Fink | 211/86 |
| 4,827,849 | 5/1989 | Vignale | 108/42 X |
| 5,398,824 | 3/1995 | Wolff et al. | 211/106 X |
| 5,405,026 | 4/1995 | Lee et al. | 211/106 X |

FOREIGN PATENT DOCUMENTS

| | | | |
|---|---|---|---|
| 2359246 | 6/1975 | Germany | 211/86 |

OTHER PUBLICATIONS

Titan Collection Catalog of Spectrum Diversified Designs, Inc of Solon, OH 44139, Models 710, 712, 714 and 410; Date Unknown.

Ft. Myers, FL *News–Press*, Section E, Apr. 28, 1996.

*Primary Examiner*—José V. Chen
*Attorney, Agent, or Firm*—Peter D. Keefe

[57] ABSTRACT

An auxiliary towel rack for interfacing with a conventional barred towel holder, composed of a single piece rod having a bar portion for holding towels, a support portion at each end of the bar portion, and an arm portion for holding, wash cloths connected with each of the support portions. Each support portion is formed by a 90 degree bend of the rod in a first plane, wherein a first section ends at a first curve formed in the rod in a second plane orthogonal to the first plane which bends toward the bar portion, a second curve formed in the rod which bends in the second plane away from the rod portion, a second section, and a third curve formed in the rod which bends in the second plane toward the bar portion. Each arm portion is connected with a respective third curve, and terminates in an end segment upturned in the second plane. The auxiliary towel rack is placed onto a bar of a conventional barred towel holder, whereupon the interior of the first curve rests upon the bar of the conventional barred towel holder and the outside radius of the third curve abuts the wall, where the bar portion is parallel to the bar of the conventional barred towel holder and the arm portions are oriented substantially perpendicular to the wall. In a variation of the auxiliary towel rack, the bar portion is wavy or helix shaped rather than straight.

20 Claims, 3 Drawing Sheets

AUXILIARY TOWEL RACK

BACKGROUND OF THE INVENTION

1. Field of the Invention

The present invention relates to wall mounted conventional barred towel holders used in bathrooms to hang towels. More particularly, the present invention is related to auxiliary towel racks which hangably interface with wall mounted conventional barred towel holders to thereby provide additional towel hanging capacity. Still more particularly, the present invention relates to an auxiliary towel rack formed by selective bending of a single piece of rod.

2. Description of the Prior Art

Conventional barred towel holders are mounted permanently to a wall, and generally are in the form of a square (or round) bar connected at each end to a mounting member, wherein the mounting members are connected to the wall so as to locate the bar about two to three inches, or so, from the wall. One problem with conventional barred towel holders is that they are intended to hang only a single unfolded towel; two towels may be hung, but they have to hang in a folded state.

Accordingly, auxiliary towel racks have been proposed to augment towel hanging capacity of conventional barred towel holders. The concept of an auxiliary towel rack is to hang it onto a conventional barred towel holders so that both the conventional barred towel holders and the auxiliary towel rack are available to hold towels. An example of an auxiliary towel rack is described in U.S. Pat. No. 4,372,449, wherein an oval member for holding towels is welded to a pair of spaced apart legs which are shaped to restably engage upon the bar of a conventional barred towel holders while also restably engaging against the wail adjacent and below the bar of the conventional barred towel holders. While the auxiliary towel rack described in U.S. Pat. No. 4,372,449 works well, it suffers from requiring the assembly and welding together of at least three parts, further, the legs have a component which transversely crosses the oval which limits the length thereof available to hold towels.

Accordingly, what remains needed in the art is an auxiliary towel rack which is of simple construction, is inexpensive to manufacture and is easy to hang and use, and which further provides for separate hanging areas for wash cloths.

SUMMARY OF THE INVENTION

The present invention is an auxiliary towel rack which is of simple construction in that it is composed of a single, unitary piece of formed rod material.

The auxiliary towel rack according to the present invention is composed of a rod having a bar portion, a support portion at each end of the bar portion, and an arm portion connected with each of the support portions. The bar portion has a length substantially nearly that of a bar of a conventional barred towel holder so that it allows for one or more towels to be placed thereupon in the same manner as the user would place one or more towels on the bar of the conventional barred towel holder. Each support portion is formed by a 90 degree bend of the rod in a first plane, wherein a first section ends at a first curve formed in the rod in a second plane orthogonal to the first plane which bends toward the bar portion preferably between 90 and 180 degrees, a second curve formed in the rod which bends in the second plane away from the rod portion preferably just under about 90 degrees, a second section, and a third curve formed in the rod which bends in the second plane toward the bar portion preferably between 90 and 180 degrees. Each arm portion is connected with a respective third curve, and terminates in an end segment upturned in the second plane.

In operation, the auxiliary towel rack is placed onto a bar of a conventional barred towel holder, whereupon the inside radius of the first curve rests upon the bar of the conventional barred towel holder and the outside radius of the third curve abuts the wall. In such position, the bar portion is located spaced outwardly from and below the bar of the conventional barred towel holder in an orientation parallel thereto. Further, each of the arm portions are oriented substantially perpendicular to the wall.

In a variation of the auxiliary towel rack according to the present invention, the bar portion is provided with multi-dimensional relief, rather than being straight The preferred relief is in the form of waves arranged in a wave plane to thereby provide two-dimensional relief. Alternatively, the relief can be in the form of a helix to thereby provide three-dimensional relief. The multi-dimensional relief serves to separate adjacent hanging portions of a towel, whereby the towel is able to dry with greater facility (than in the case of a straight bar portion).

Accordingly, it is an object of the present invention to provide an auxiliary towel rack of simple, unitary construction for being hung on a conventional barred towel holder.

It is an additional object of the present invention to provide an auxiliary towel rack having provision for holding towels and, separately, wash clothes, wherein the wetness of one does not affect the other.

It is another object of the present invention to provide an auxiliary towel rack constructed of a single piece of rod, which is inexpensive to manufacture and easy to hang and use.

It is yet an additional object of the present invention to provide an auxiliary towel rack having provision for holding towels and, separately, wash clothes, wherein the bar portion thereof for holding towels is provided with multidimensional relief to facilitate drying of hung towels.

These, and additional objects, advantages, features and benefits of the present invention will become apparent from the following specification.

DESCRIPTION OF THE DRAWINGS

FIGS. 5A, 5B, 4C and 4D are end views serially depicting a second procedure for hanging the auxiliary towel rack according to the present invention with respect to a conventional barred towel holder, wherein the bar portion is inserted firstly.

DETAILED DESCRIPTION OF THE PREFERRED EMBODIMENTS

Figure 1:
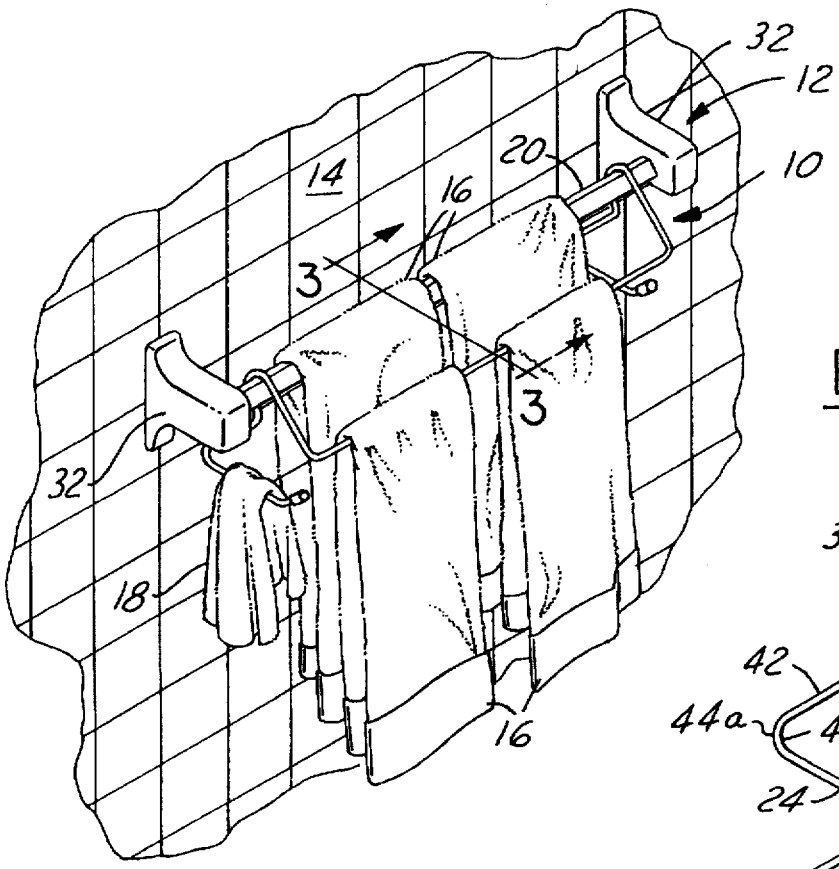
FIG. 1 is a perspective view of the auxiliary towel rack according to the present invention, shown in operation with respect to a conventional barred towel holder, towels and wash cloths.
Figure 3:
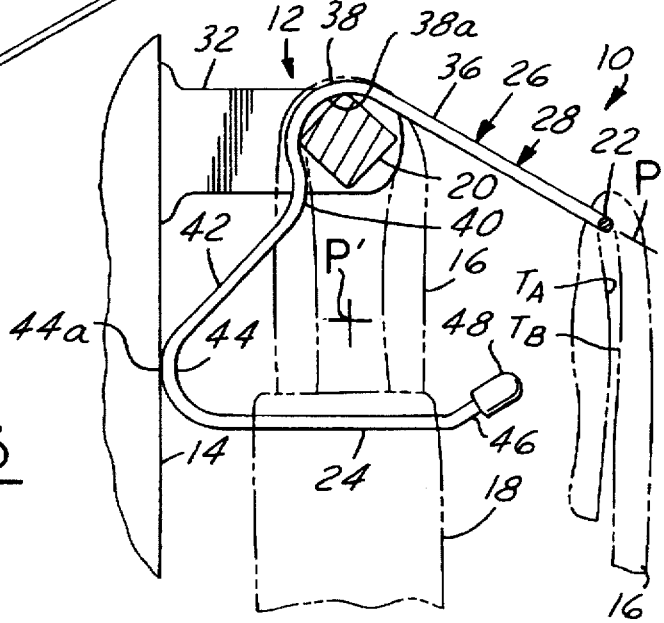
FIG. 3 is an end view of the auxiliary towel rack according to the present invention, shown in operation with respect to a conventional barred towel holder, wherein towels and wash cloth are shown in phantom.
Figure 4A:
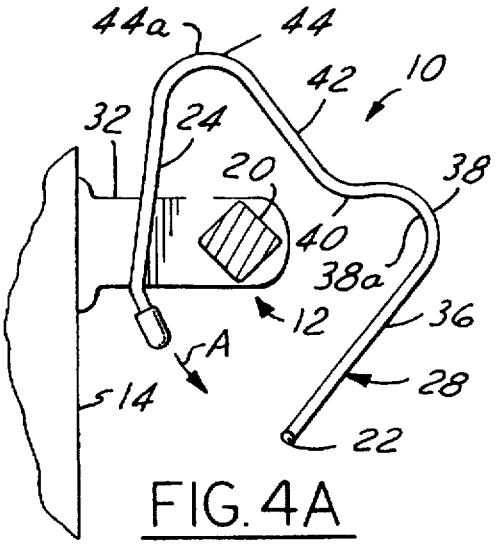
FIGS. 4A, 4B, 4C, and 4D are end views serially depicting a first procedure for hanging the auxiliary towel rack according to the present invention with respect to a conventional barred towel holder, wherein the arm portions are inserted firstly.
Figure 4B:
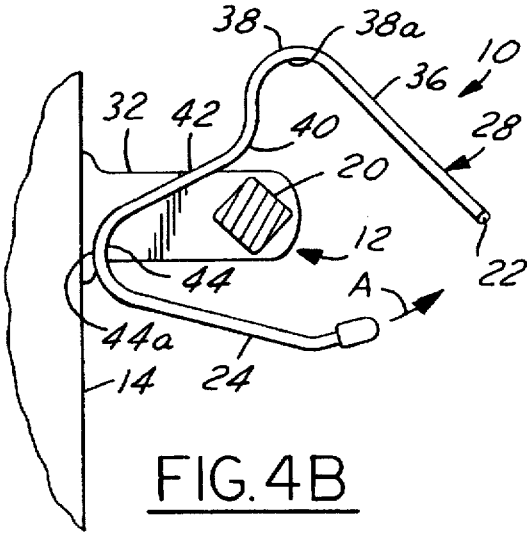
Figure 4C:
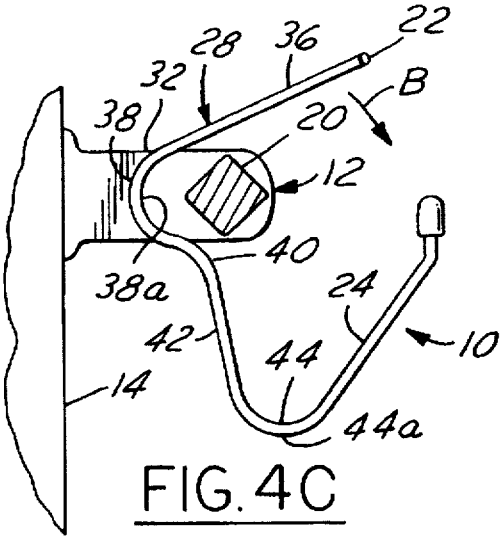
Figure 4D:
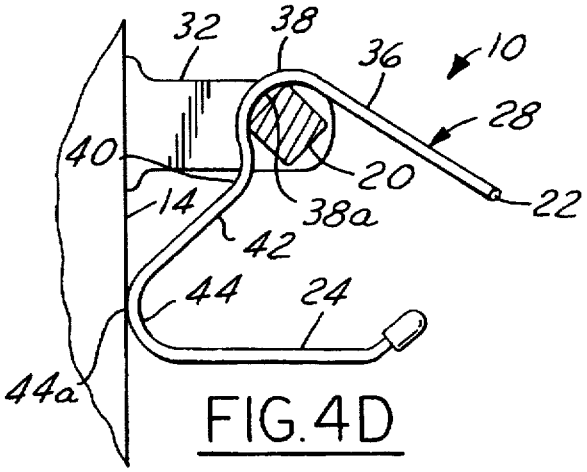
Figure 5A:
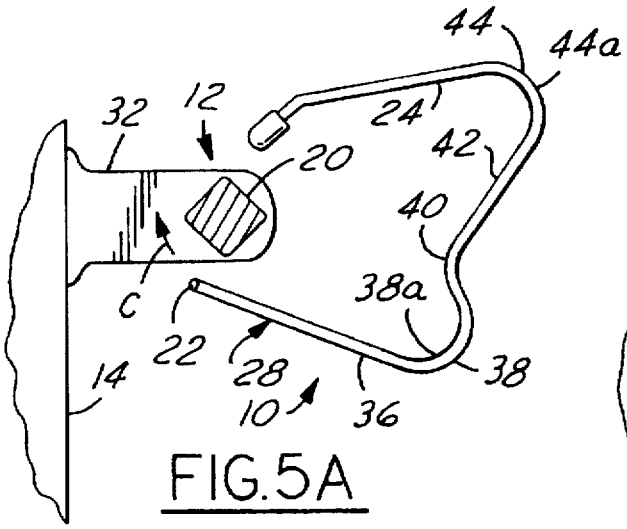
Figure 5B:
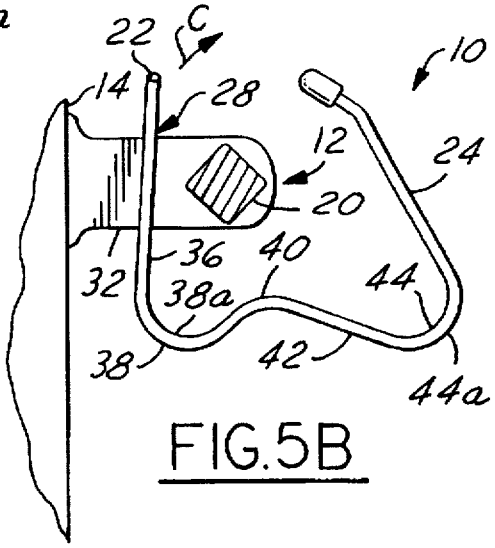

Referring now to the Drawing, FIGS. 1 and 3 depict the auxiliary towel rack 10 according to the present invention in operation with a conventional barred towel holder 12, the adjacent wall 14 to which the conventional barred towel holder is attached, towels 16, and wash cloths 18. The auxiliary towel rack 10 hangs onto the bar 20 of the conventional barred towel holder 12 and is buttressed against the adjacent wall 14 below the bar 20. The auxiliary towel rack 10 includes a bar portion 22, which is dimensioned to hold towels in the same manner as the bar 20 of the conventional barred towel holder 12, wherein the bar portion is spaced from the bar 20 of the conventional barred towel holder sufficiently to allow easy and unobstructed access of any of the towels being hung on either bar. Furthermore, the auxiliary towel rack 10 includes a pair of arm portions 24 which are dimensioned to hold wash cloths separately from the towels 16. Accordingly, the auxiliary towel rack 10 provides essentially double the hanging space for towels and, what is more, provides yet even more space for hanging wash cloths over and above what would normally be available with simply the conventional barred towel holder alone. Still further, the separate hanging of towels and wash cloths ensures that if either of the towels or wash cloths are wet, the wetness will not be acquired by the other dry wash cloths or towels.

Figure 2:
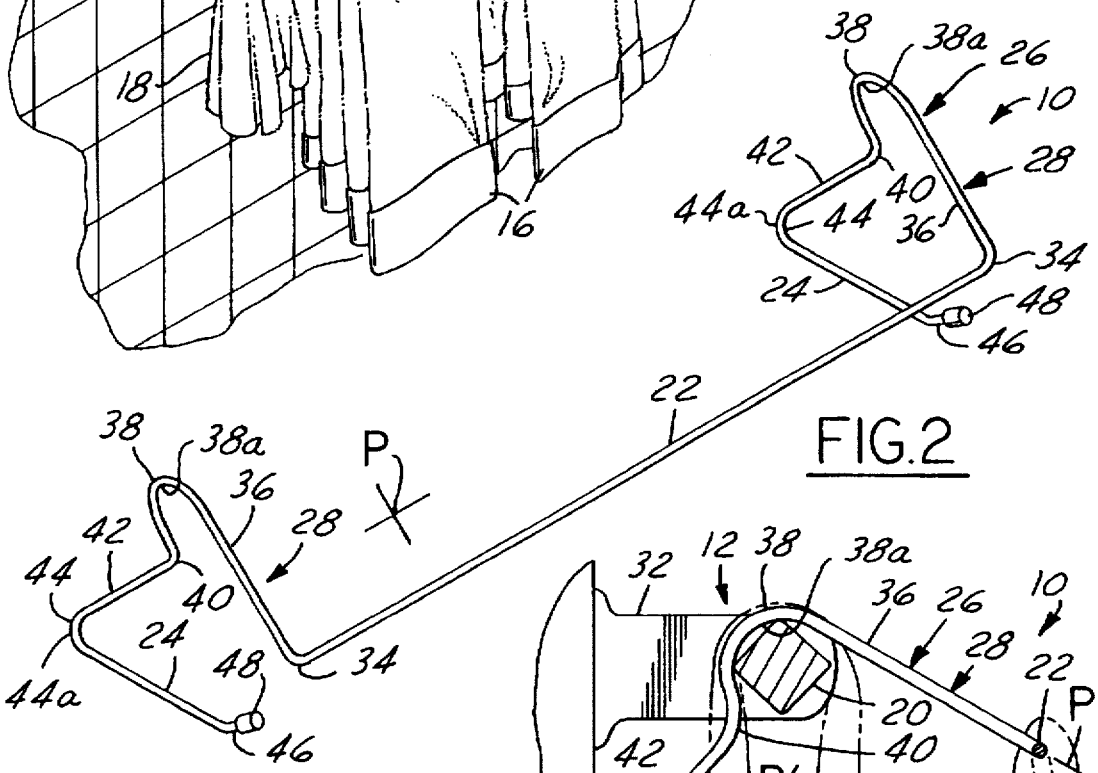
FIG. 2 is a perspective view of the auxiliary towel rack according to the present invention

The structure and function of the auxiliary towel rack 10 will now be detailed with greater specificity with reference now being additionally directed to FIGS. 2 through 5B As shown best by FIGS. 2 and 3, the auxiliary towel rack 10 is composed of a singular rod 26, preferably, but not necessarily, a metallic rod. The rod 26 may or may not be painted or plastic coated, or otherwise finished; however, a plastic coated steel rod is preferred, wherein the rod has a diameter of about one-quarter inch. Where metal is used, the rod 26 is provided initially straight and then is then bent into a variety of bends into the shape seen in FIG. 2. The bending process is carried out preferably by a customized tool or other machine well known in the art. The following distinctive portions of the rod 26 are notable upon completion of the bending process: a bar portion 22, a support portion 28 at each end of the bar portion, and an arm portion 24 connected with each of the support portions.

The bar portion 22 has a length substantially nearly that of a bar 20 of a conventional barred towel holder 12, such that the support portions 28 are able to be received on the bar 20 of the conventional barred towel holder between the mounting members 32 thereof. The bar portion 22 is also long enough so that one or more towels 16 are placeable thereupon in the same manner as the user would place one or more towels on the bar 20 of the conventional barred towel holder 12. In the preferred embodiment shown in FIGS. 1 through 5B the bar portion 22 is straight. However, the bar portion 22 may be other than straight to provide a multi-dimensional relief which will be discussed in detail hereinbelow.

Each support portion 28 is formed by a 90 degree bend 34 of the rod 26 in a first plane P. Each support portion 28 has a first section 36 which adjoins a respective end of the bar portion 22 at the bend 34. The first section 36 is preferably straight and ends at a first curve 38 formed in the rod 26 in a second plane P' that is orthogonal to the first plane P. The first curve 38 bends toward the bar portion 22 preferably between 90 and 180 degrees, most preferably about 145 degrees. Closely adjacent the first curve 38 is a second curve 40 formed in the rod 26 which bends preferably just under about 90 degrees, most preferably about 80 degrees, in the second plane P' oppositely to the direction of bend of the first curve. A second section 42 is preferably straight and extends from the second curve 40. A third curve 44 is formed in the rod 26 and bends preferably between 90 and 180 degrees, most preferably about 130 degrees, in the second plane P' toward the bar portion 22.

The inside radius 38*a* of the first curve 38 is shaped to bend around a portion of the bar 20 of a conventional barred towel holder 12, as shown generally at FIGS. 1 and 3. The outside radius 44*a* of the third curve 44 is structured to abut the wall 14 adjacent the conventional barred towel holder 12 at a location below the bar 20. The combination of the interface of the first and third curves 38, 44 with the bar 20 and the wall 14, respectively, provide a fixed and secure placement of the auxiliary towel rack 10 with respect to the conventional barred towel holder 12, as shown in FIG. 1.

Each arm portion 24 is connected with a respective third curve 44, and terminates in an end segment 46 formed by a bend in the rod 26 which is upturned in the second plane P'. The end segment 46 is not essential, but is preferred as a keeper to prevent wash cloths from accidentally falling off the end of the arm portion 24. An end cap 48 is preferably provided at each end of the rod 26 (the ends of the rod being also the ends of the arm portions 24).

A dimensional example will now be given by way of illustration only, for instructive purposes (not limitation) with respect to a conventional barred towel holder 12 having a bar 16 inches in length, the bar being located 2.5 inches from the wall. The rod 26 is composed of steel having a diameter of one-quarter inch. The bar portion 22 has a length of about 15.5 inches, each bend 34 is 90 degrees, the first section 36 has a length of about 7 inches, the first curve 38 is bent about 145 degrees in relation to the first section, the second curve 40 is bent about 80 degrees opposite to the first curve, the second section has a length of about 2.5 inches, the third curve 44 is bent about 130 degrees in relation to the second section, and the arm portion 24 has a length of about 3 inches. After hanging, the bar portion 22 is spaced about 5 inches from the bar 20 (about 3 inches therebelow), the outside radius of each of the third curves 44 is located about 3.5 inches below the bar 20, and the arm portions 24 are located about 4 inches below the bar 20. The length of the bar portion 22 may be longer or shorter than 15.5 inches in order to accommodate a particular length bar 20 of a conventional barred towel holder 12 (i.e., a bar portion 22 of about 21.5 inches to fit a 24 inch bar).

How the auxiliary towel rack 10 is hung upon a conventional barred towel holder 12 is illustrated sequentially by FIGS. 4A through 5B. In this regard, there are two procedures to hang the auxiliary towel bar: with the arm portions 24 leading, or with the bar portion 22 leading.

The hanging procedure having the arm portions 24 leading is sequentially illustrated by FIGS. 4A through 4D, and is the most preferred hanging procedure. Essentially, the user locates the auxiliary towel rack 10 above the bar 20 and then rotatably moves the auxiliary towel rack 10 about the bar 20 of the conventional barred towel holder 12 along arrow A until the inside radius 38*a* of the first curve 38 is aligned between the wall 14 and the bar 20, whereupon rotation is reversed along arrow B and the auxiliary towel rack repositioned so that the inside radius 38*a* of the first curve 38 seats upon the bar 20 and concomitantly the outside radius 44*a* of the third curve 44 abuts the wall 14.

The hanging procedure having the bar portion 22 leading is sequentially illustrated by FIGS. 5A, 5B, 4C and 4D. Essentially, the user locates the auxiliary towel rack 10 beneath the bar 20 and then rotatably moves the auxiliary towel bar 10 about the bar 20 of the conventional barred towel holder 12 along arrow C until the inside radius 38*a* of the first curve 38 is aligned between the 14 and the bar 20, whereupon rotation continues along arrow B and the auxiliary towel rack repositioned so that the inside radius 38*a* of the first curve 38 seats upon the bar 20 and concomitantly the outside radius 44*a* of the third curve 44 abuts the wall 14.

In operation, the auxiliary towel rack 10 is placed onto a bar 20 of a conventional barred towel holder 12 in the manner hereinabove described. Now, the interior radius 38*a* of the first curve 38 rests on the bar 20 of the conventional barred towel holder 12 and the exterior radius 44*a* of the third curve 44 abuts the wall 14 beneath the bar 20. In such position, the bar portion 22 is located spaced outwardly from (as for example about 4 inches) and preferably below (as for example about 3 inches) the bar 20 of the conventional barred towel holder 12 in an orientation parallel thereto. Further, each of the am portions 24 are oriented substantially perpendicular to the wall 14.

Figure 6:
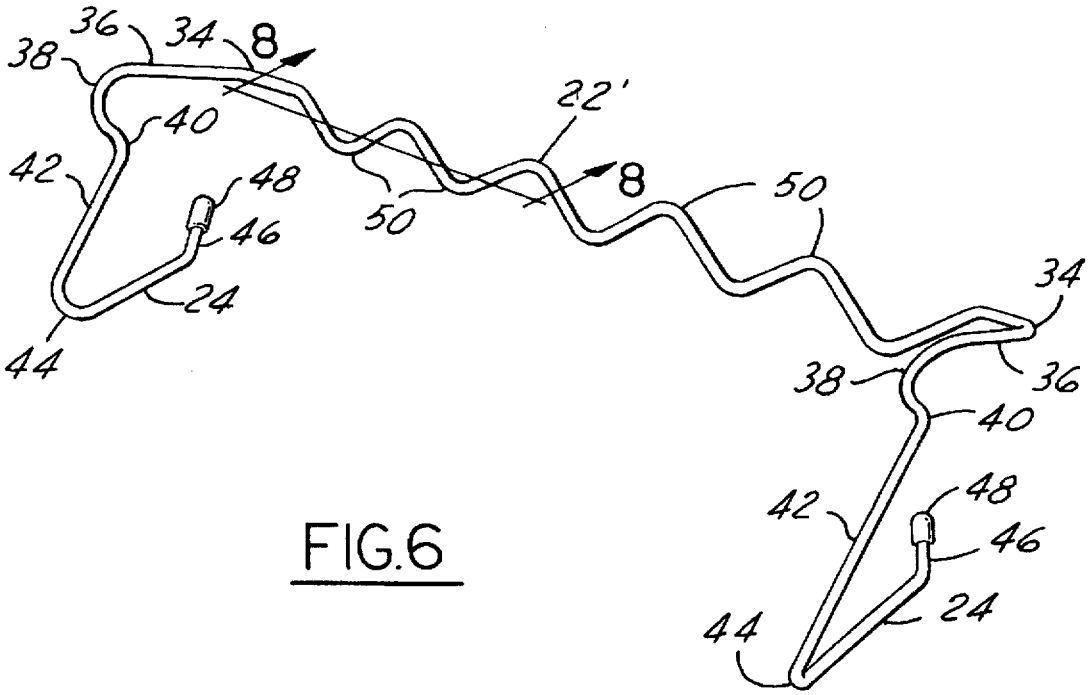
FIG. 6 is a perspective view of an alternative embodiment of the auxiliary towel rack according to the present invention, wherein the bar portion thereof is provided with a multi-dimensional relief in the form of waves.

A variation of the auxiliary towel rack 10' according to the present invention is shown at FIGS. 6 though 8. The aforesaid structural features are the same and therefore the same numerals are used refer to these same structures, except that now the bar portion 22' is provided with multi-dimensional relief, rather than being straight. The multi-dimensional relief may be in two dimensions or in three dimensions.

Figure 7:
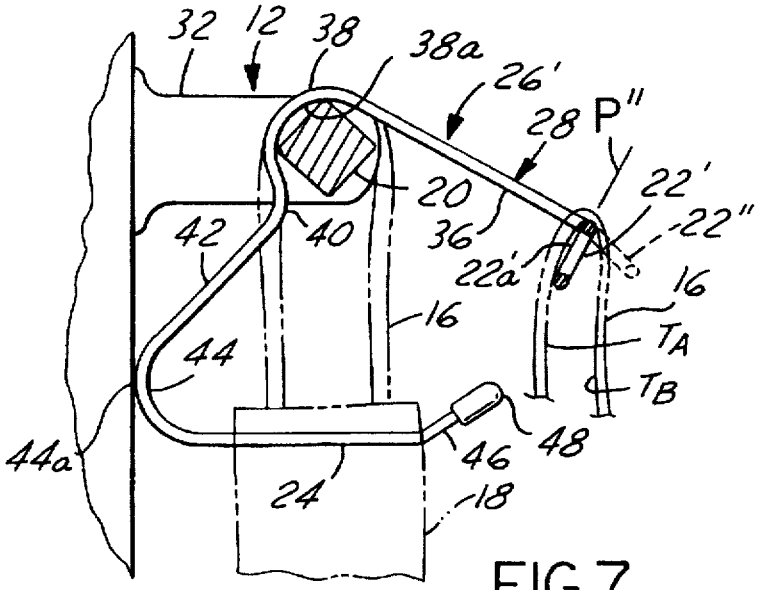
FIG. 7 is an end view of the auxiliary towel rack according to the alternative embodiment of the present invention, shown in operation with respect to a conventional barred towel holder, wherein towels and wash cloth are shown in phantom.
Figure 8:
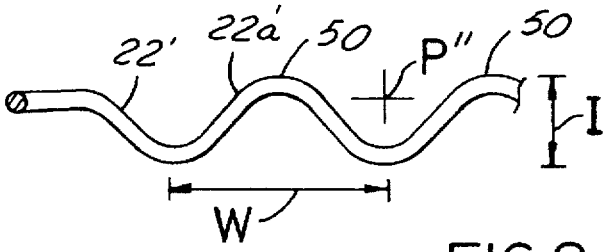
FIG. 8 is a broken away side view of the bar portion of the alternative embodiment of the auxiliary towel bar rack, seen along line 8—8 in FIG. 6.

An example of a two dimensional relief is shown in FIGS. 6 through 8, wherein waves 50 are provided at the bar portion 22*a*' by wavy bending of that portion of the rod 26. The wave plane P" in which the waves 50 are formed is preferably normal to the first sections 36 (thus, the wave plane P" is orthogonal to both the first and second planes P, P"), as shown by FIG. 7. Other orientations of the wave plane P" are possible (see phantom orientation of the wave plane of the bar portion 22*a*' in FIG. 7). In any event, the intendment is for the waves 50 to provide some separation of the adjacent hanging portions of a towel Ta, Tb, whereby the towel is able to dry with greater facility (compare FIGS. 3 and 7). By way of exemplary illustration (not limitation), for a bar portion 22*a*' of 15.5 inches in length, there may be 5 complete waves W, having a total amplitude I of about 1.5 inches.

Figure 9:
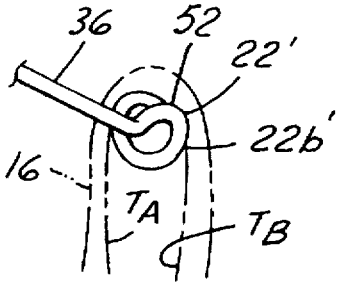
FIG. 9 is a perspective view of an alternative embodiment of the auxiliary towel rack according to the present invention, wherein the bar portion thereof is provided with a multi-dimensional relief in the form of a helix.

An example of a three dimensional relief is shown in FIG. 9, wherein the bar portion 22*b*' is provided with a helix 52 composed of a plurality of turns. The helix 52 is shaped to provide the aforementioned towel drying feature. As an example of a helix 52, the helix cross-section is about one inch or so, and there are about 5 to 8 or so turns along the bar portion 22*b*'.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. An auxiliary towel rack for being used in connection with a conventional barred towel holder having a bar, wherein the conventional barred towel holder is mounted to a wall, said auxiliary towel rack comprising:

a single piece of rod, said rod having a plurality of portions comprising:

a bar portion having a first bar end and an opposite second bar end;

a pair of support portions connected respectively to said first and second bar ends, wherein said pair of support portions are formed by a bend of said rod in a first plane at each of said first and second bar ends, each support portion comprising:

a first section having a first end and an opposite second end, said first end of said first section adjoining one of said first and second bar ends;

a first curve formed in said rod at said second end of said first section, said first curve being formed in a second plane;

a second curve formed in said rod adjacent said first curve, said second curve being curved in a direction opposite to said first curve in said second plane;

a second section having a first end and an opposite second end, said first end of said second section adjoining said second curve; and a third curve formed in said rod at said second end of said second section, said third curve being curved in a direction opposite to said second curve in said second plane.

2. The auxiliary towel rack of claim 1, wherein said rod has multi-dimensional relief at said bar portion.

3. The auxiliary towel rack of claim 2, wherein said plurality of portions further comprises a pair of arm portions, wherein one arm portion of said pair of arm portions-adjoins said third curve of one support portion of said pair of support portions, and wherein the other arm portion of said plurality of arm portions adjoins said third curve of the other arm portion of said plurality of arm portions.

4. The auxiliary towel rack of claim 3, wherein said multi-dimensional relief comprises a plurality of waves oriented in a wave plane.

5. The auxiliary towel rack of claim 4, wherein said wave plane is substantially orthogonal to said first and second planes.

6. The auxiliary towel rack of claim 3, wherein said multi-dimensional relief comprises a helix.

7. The auxiliary towel rack of claim 3, wherein said bend of said rod at each of said first and second bar ends is substantially 90 degrees; further wherein said first and second planes are mutually substantially orthogonal.

8. The auxiliary towel rack of claim 7, wherein said first curve is curved substantially 145 degrees with respect to said first section, said second curve is curved substantially 80 degrees oppositely with respect to said first curve, and said third curve is curved substantially 130 degrees with respect to said second section.

9. The auxiliary towel rack of claim 8, where said first and second sections are substantially straight.

10. The auxiliary towel rack of claim 9, wherein said arm portion terminates in an end segment upturned in said second plane.

11. The auxiliary towel rack of claim 1, wherein said plurality of portions further comprises a pair of arm portions, wherein one arm portion of said pair of arm portions adjoins said third curve of one support portion of said pair of support portions, and wherein the other arm portion of said plurality of arm portions adjoins said third curve of the other arm portion of said plurality of arm portions.

12. The auxiliary towel rack of claim 11, wherein said bend of said rod at each of said first and second bar ends is substantially 90 degrees; further wherein said first and second planes are mutually substantially orthogonal.

13. The auxiliary towel rack of claim 12, wherein said first curve is curved substantially 145 degrees with respect to said first section, said second curve is curved substantially 80 degrees oppositely with respect to said first curve, and said third curve is curved substantially 130 degrees with respect to said second section.

14. The auxiliary towel rack of claim 13, wherein said first and second sections are substantially straight.

15. The auxiliary towel rack of claim 14, wherein said arm portion terminates in an end segment upturned in said second plane.

16. An auxiliary towel rack for being used in connection with a conventional barred towel holder having a bar, wherein the conventional barred towel holder is mounted to a wall, said auxiliary towel rack comprising:

a single piece of metallic rod, said rod being bent into a plurality of portions comprising:

a bar portion having a first bar end and an opposite second bar end;

a pair of support portions connected respectively to said first and second bar ends, wherein said pair of support portions are formed by a bend of said rod in a first plane at each of said first and second bar ends, each support portion comprising:

a first section having a first end and an opposite second end, said first end of said first section adjoining one of said first and second bar ends;

a first curve formed in said rod at said second end of said first section, said first curve being formed in a second plane;

a second curve formed in said rod adjacent said first curve, said second curve being curved in a direction opposite to said first curve in said second plane;

a second section having a first end and an opposite second end, said first end of said second section adjoining said second curve; and a third curve formed in said rod at said second end of said second section, said third curve being curved in a direction opposite to said second curve in said second plane.

17. The auxiliary towel rack of claim 16, wherein said rod has multi-dimensional relief at said bar portion.

18. The auxiliary towel rack of claim 16, wherein said plurality of portions further comprises a pair of arm portions, an arm portion adjoining, respectively, each said third curve.

19. The auxiliary towel rack of claim 18, wherein said rod has multi-dimensional relief at said bar-portion.

20. An auxiliary towel rack for being used in connection with a conventional barred towel holder having a bar, wherein the conventional barred towel holder is mounted to a wall, said auxiliary towel rack comprising:

a single piece of rod, said rod having a plurality of portions comprising:

a bar portion having a first bar end and an opposite second bar end;

a pair of support portions connected respectively to said first and second bar ends, wherein said pair of support portions are formed by a bend of said rod in a first plane at each of said first and second bar ends, each support portion comprising:

a first section having a first end and an opposite second end, said first end of said first section adjoining one of said first and second bar ends;

a first curve formed in said rod at said second end of said first section, said first curve being formed in a second plane;

a second curve formed in said rod adjacent said first curve, said second curve being curved in a direction opposite to said first curve in said second plane;

a second section having a first end and an opposite second end, said first end of said second section adjoining said second curve; and a third curve formed in said rod at said second end of said second section, said third curve being curved in a direction opposite to said second curve in said second plane; and a pair of arm portions, wherein one arm portion of said pair of arm portions adjoins said third curve of one support portion of said pair of support portions, and wherein the other arm portion of said plurality of arm portions adjoins said third curve of the other arm portion of said plurality of arm portions.

* * * * *